United States Patent [19]

Hafner, Jr. et al.

[11] Patent Number: 4,827,205

[45] Date of Patent: May 2, 1989

[54] ON-CHIP VOLTAGE SUPPLY REGULATOR

[75] Inventors: Warren G. Hafner, Jr., Lake Carmel, N.Y.; John R. Lowdenslager, Bethel, Conn.

[73] Assignee: Pitney Bowes Inc., Stamford, Conn.

[21] Appl. No.: 135,896

[22] Filed: Dec. 21, 1987

[51] Int. Cl.[4] ..... G05F 1/46

[52] U.S. Cl. ..... 323/281; 323/314; 323/316

[58] Field of Search ..... 323/231, 280, 281, 311, 323/313, 314, 315, 316

[56] References Cited

U.S. PATENT DOCUMENTS 3,805,145 4/1974 Gordon ..... 323/280
3,959,717 5/1976 Pitel ..... 323/280
4,158,804 6/1979 Butler et al. ..... 323/281
4,260,946 4/1981 Wheatley, Jr. ..... 323/281

*Primary Examiner*—Peter S. Wong
*Attorney, Agent, or Firm*—Michael J. DeSha; David E. Pitchenik; Melvin J. Scolnick

[57] ABSTRACT

A voltage regulator fabricated on an integrated circuit chip to provide regulated voltage for the chip assures that the integrated chip is operational before conventionally provided external regulated voltages are available. This enables the integrated circuit chip to be used to monitor the external regulated voltage supplies and prevents latch-up of the integrated circuit due to improper voltages being applied during power sequencing.

5 Claims, 1 Drawing Sheet

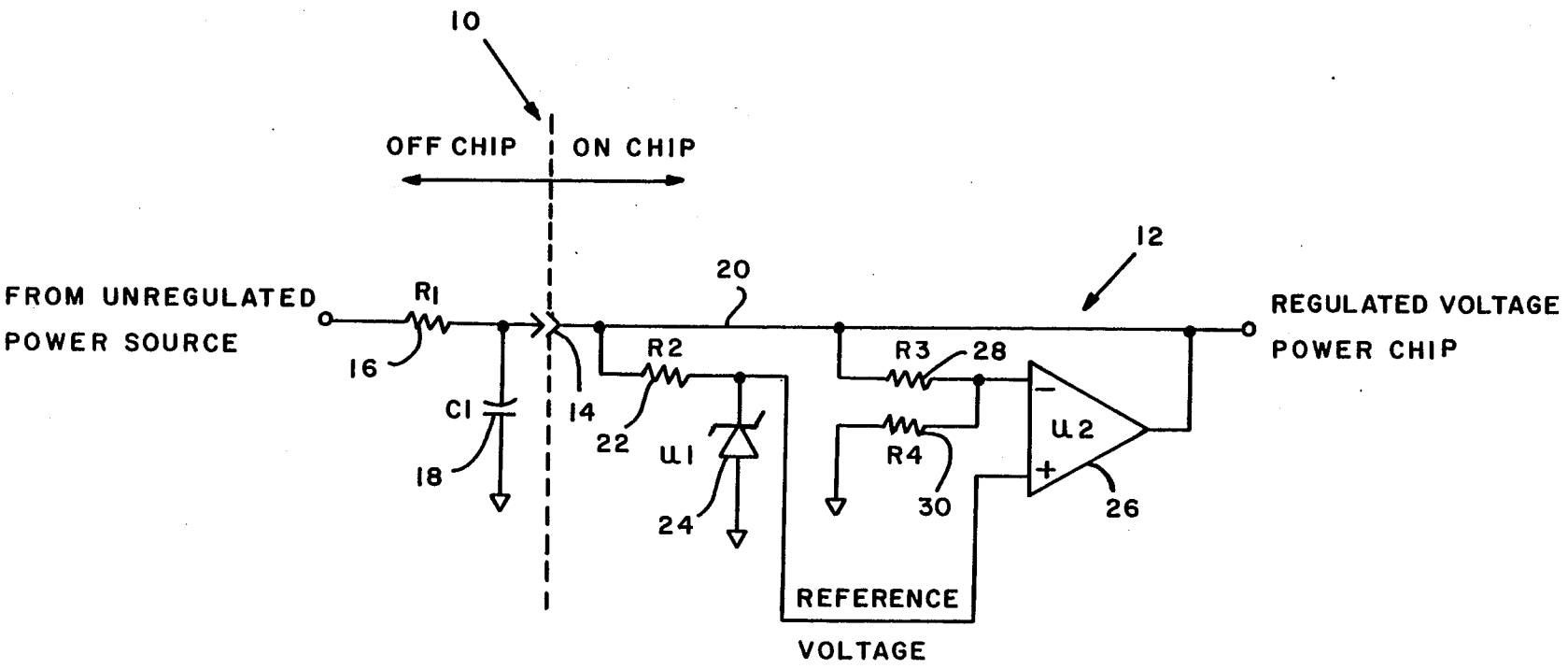
REGULATED VOLTAGE
POWER CHIP
12
26
U2
28
R3
R4
30
REFERENCE
VOLTAGE
20
R2
U1
24
22
14
ON CHIP
OFF CHIP
10
R1
C1
18
16
FROM UNREGULATED
POWER SOURCE

ON-CHIP VOLTAGE SUPPLY REGULATOR

BACKGROUND OF THE INVENTION

The invention relates to voltage regulators and more particularly to a voltage regulator to be fabricated as a part of an integrated circuit chip to internally provide the regulated power required for the operation of the chip.

Integrated circuit chips are well known. They require for their operation predetermined regulated voltages. Such regulated voltages are conventionally provided by an outside source; however there has been found to be a problem when using such outside sources for particular integrated circuit applications as for example when there is a further requirement for using such chip for monitoring of the output of such an external power supply.

A P-channel MOSFET will be used as an example to illustrate the problem. Conventionally in a P-channel MOSFET, the P-well source and drain are imbedded in an N substrate material. For operation, the N substrate is connected to a positive power supply voltage and the source and drain must be connected to a less positive potential, since the known diode effect created at the source-substrate junction and the drain-substrate junction between the P-well material and the N substrate material prevents the application of a voltage more positive than the substrate to the source or drain of any P-channel FET.

In many environments, it may be desirable to monitor both regulated and unregulated voltages provided by an external source for providing power-up and power-down signals or for signalling a power interruption of any sort. However, the voltages to be monitored are those which are typically required to power the monitoring chip itself. It is therefore extremely important that the monitoring chip be operational prior to the application of a regulated voltage to any other device and it is important to insure that the regulated voltage to the chip always be, again in the case of a P-channel MOSFET as an example, more positive than the voltage applied to the source or drain of any P-channel FET on the chip.

Various techniques have been used to assure that such inappropriate potentials cannot occur, but there has still been found to be the possibility of a potential latching of the MOSFETs because the substrate on power-up or power-down may become less positive than voltages applied to the source or drain of any MOSFETs on the chip.

For example, U.S. Pat. No. 4,347,476 issued to Tam entitled VOLTAGE-TEMPERATURE INSENSITIVE ON-CHIP REFERENCE VOLTAGE SOURCE COMPATIBLE WITH VLSI MANUFACTURING TECHNIQUES shows a reference voltage source which is temperature and voltage insensitive. Gilbert, et al., in U.S. Pat. No. 4,313,083 entitled TEMPERATURE COMPENSATED IC VOLTAGE REFERENCE also shows a temperature compensated IC voltage reference. Hoff, Jr., U.S. Pat. No. 4,100,437 entitled MOS REFERENCE VOLTAGE CIRCUIT shows a stable reference circuit which is stable for both temperature and power supply variations including variations in a substrate biasing potential.

U.S. Pat. No. 4,473,758 to Huntington entitled SUBSTRATE BIAS CONTROL CIRCUIT AND METHOD teaches a substrate bias control method utilizing MOSFET devices to control the application of potentials to the chip.

Therefore, it is an object of the invention to provide an integrated circuit chip power supply which is operational before any other regulated supply has reached a nominal voltage. This means that the integrated circuit chip may be used to monitor other voltages and may be used for critical signal controls.

It is a further object to have an integrated circuit chip be operational for a predetermined period of time after other regulated power supplies are powered down.

It is another object of the invention to provide an integrated circuit chip which has a regulated voltage power supply which may be used when no other regulated voltage power supply is available.

It is another object to provide an integrated circuit chip with power supply of which is isolated from other regulated power supplies.

SUMMARY OF THE INVENTION

It was discovered that the problem of assuring that an integrated circuit chip is operational before other voltage regulators and without any possibility of any latch-up could be solved in accordance with the invention by the fabrication of a novel voltage regulator on the integrated circuit chip itself to provide the power for the chip. The regulator comprises an operational amplifier whose output is connected to a voltage input of the integrated circuit chip. The operational amplifier compares a divided voltage to a voltage reference on the integrated circuit chip and sinks current in an amount which is inversely proportional to the magnitude of the error between the reference voltage and the divided voltage.

The circuit may be fabricated and used with an integrated circuit such as the one described for example in U.S. Pat. No. 4,701,856 issued Oct. 20, 1977 and specifically incorporated by reference herein.

BRIEF DESCRIPTION OF THE DRAWING

The FIGURE shows an on-chip voltage supply regulator coupled to an external source of unregulated power.

DESCRIPTION OF THE PREFERRED EMBODIMENT

Referring to the FIGURE, a voltage supply regulator 12 is shown as part of a chip 10 which is indicated here only by a dotted line. It will be understood that conventional chip fabrication techniques may be used in implementing a circuit in accordance with the invention and these techniques will not be discussed herein. The integrated circuit chip may be, suitably, as one shown in U.S. Pat. No. 4,701,856, previously incorporated by reference.

The chip 10 is shown connected to receive unregulated power at a terminal 14. In the preferred embodiment, terminal 14 is connected to the external power source (not shown) through resistor 16. Capacitor 18 is shown connected between the end of resister 16 which is connected to terminal 14 and ground in order to smooth any ripples in the unregulated voltage. Typically, the external power source would supply power at a nominal 10 volts and typical values for resistor 16 would be 50 and for capacitor 18 would be 0.1 pF.

The terminal 14 is connected internally to the chip through lead 20 to provide the regulated voltage to power the remainder of the chip.

The voltage supply regulator 12 internal to the chip comprises a resistor 22 coupled to a reference voltage device such as a band-gap device 24 which is in turn connected to ground. It will be appreciated that other reference sources, for example, zener diodes may be utilized in place of the band-gap device shown. It will also be understood that the ground potential referred to herein may be any other common potential instead.

The junction of the resistor 22 and the band-gap device or zener diode 24 is connected to the non-inverting input of operational amplifier 26. In the illustrated embodiment, the value of resistor 22 is 10K and band-gap device or zener diode 24 would be nominally 2.5 v volts.

Resistor divider network comprising resistors 28 and 30 is also coupled between the lead 20 from terminal 12 and ground. The junction of resistors 28 and 30 is connected to the inverting input of operational amplifier 26 to provide a divided output voltage from this resistor network to the inverting input. For the illustrated embodiment, the values for resistor 28 is 10K and for resistor 30 is 10K.

The output of the operational amplifier is coupled to the lead 20.

In operation, the resistor 16 serves to drop the voltage difference between the unregulated voltage from the unregulated power source and the desired regulated voltage. Capacitor C1 operates in known manner to reduce any ripple in the unregulated voltage.

The resistor 22 internal to the integrated circuit chip serves to drop the voltage difference between the desired regulated voltage and the reference voltage determined by band-gap zener diode 24 which provides the reference voltage for the chip voltage regulator.

The resistance values of resistor 28 and resistor 30 of the resistor voltage divider are chosen such that the input to the inverting input of the operational amplifier is equal to the referenced voltage when the regulated voltage is at its nominal value. The operational amplifier 26 measures the voltage error between the referenced voltage and the divided regulated voltage and sinks current to ground in conventional manner in an amount which is inversely proportional to the magnitude of the error between the referenced voltage and the divided regulated voltage.

It will be appreciated that the current through resistor 16 determines the value of the regulated voltage and that this current is the sum of the load provided by the remainder of the chip and the current through the operational amplifier 26.

What is claimed is:

1. An integrated circuit voltage supply regulator circuit in an integrated circuit chip comprising:

an operational amplifier in an integrated circuit chip, the operational amplifier having an inverting input, a non-inverting input and an output;

a terminal on said chip for connection to an external source of voltage;

a resistor connected to the terminal and a reference voltage device, said reference voltage device being connected between the resistor and chip common potential, the reference voltage at a junction of the resistor and the reference voltage device being connected to an input of the operational amplifier;

a resistor divider network connected between said terminal and chip ground potential and connected to said operational amplifier for providing a divided voltage corresponding to a desired regulated voltage to the other input of the operational amplifier;

the output of the operational amplifier being connected to said terminal to provide on-chip regulated voltage for providing power to the chip.

2. The voltage regulator of claim 1 wherein said reference voltage device is a zener diode.

3. The voltage regulator of claim 1 wherein said reference voltage device is a band-gap device.

4. A voltage regulator for an integrated circuit comprising:

an operational amplifier in an integrated circuit chip, the operational amplifier having an inverting input, a non-inverting input and an output;

a terminal on said chip for connection to an external source of voltage;

a resistor connected to the terminal and a reference voltage device, said reference voltage device being connected between the resistor and chip common potential, the reference voltage at a junction of the resistor and the reference voltage device being connected to an input of the operational amplifier;

a resistor divider network connected to said operational amplifier for providing a divided voltage corresponding to a desired regulated voltage to the other input of the operational amplifier;

the output of the operational amplifier being connected to said terminal to provide on-chip regulated voltage for providing power to the chip;

means for providing external power to the terminal on said chip.

5. The voltage regulator of claim 4 wherein said means for providing external power comprises a resistor for dropping an unregulated voltage to a predetermined nominal voltage for regulation.

* * * * *